US009217589B2

(12) United States Patent
Bonnefoi et al.

(10) Patent No.: US 9,217,589 B2
(45) Date of Patent: Dec. 22, 2015

(54) REFRIGERATION COMPRESSOR THAT MAINTAINS A SATISFACTORY OIL LEVEL

(71) Applicant: DANFOSS COMMERCIAL COMPRESSORS, Trevoux (FR)

(72) Inventors: Patrice Bonnefoi, Saint Didier au Mont D'Or (FR); Philippe Dugast, Saint Bernard (FR)

(73) Assignee: DANFOSS COMMERCIAL COMPRESSORS, Trevoux (FR)

( * ) Notice: Subject to any disclaimer, the term of this patent is extended or adjusted under 35 U.S.C. 154(b) by 472 days.

(21) Appl. No.: 13/657,485

(22) Filed: Oct. 22, 2012

(65) Prior Publication Data

US 2013/0098100 A1 Apr. 25, 2013

(30) Foreign Application Priority Data

Oct. 20, 2011 (FR) ..... 11 59476

(51) Int. Cl.
*F25B 31/00* (2006.01)
*F04B 39/02* (2006.01)
(Continued)

(52) U.S. Cl.
CPC ..... *F25B 31/002* (2013.01); *F04B 39/023* (2013.01); *F04B 39/0238* (2013.01); *F01C 1/0215* (2013.01); *F01C 21/001* (2013.01); *F01C 21/002* (2013.01); *F04C 18/02* (2013.01); *F04C 18/0215* (2013.01); *F04C 23/008* (2013.01); *F04C 29/028* (2013.01); *F04C 29/042* (2013.01);
(Continued)

(58) Field of Classification Search
CPC ..... F25B 31/002; F25B 31/004; F25B 43/02
USPC ..... 418/55.6, 57, 97, 99–100; 62/468, 470, 62/474, 475
See application file for complete search history.

(56) References Cited

U.S. PATENT DOCUMENTS 3,140,041 A * 7/1964 Kramer et al. ..... 417/338
5,688,109 A * 11/1997 Matsuura et al. ..... 417/228
(Continued)

FOREIGN PATENT DOCUMENTS

EP 0 715 133 A1 6/1996
WO WO 2009/149726 A1 12/2009

OTHER PUBLICATIONS

French Search Report issued in French Patent Application No. 1159476 dated Aug. 27, 2012 (w/ translation).

*Primary Examiner* — Justin Jonaitis
*Assistant Examiner* — Christopher Brunjes
(74) *Attorney, Agent, or Firm* — Oliff PLC

(57) ABSTRACT

The refrigeration compressor according to the invention comprises a sealed enclosure containing a compression stage (7) and provide with a refrigerant inlet and outlet (6, 18), the compressor being configured such that under usage conditions, a flow of refrigerant circulates through the refrigerant inlet, the compression stage, and the refrigerant outlet. The compressor has an oil pan (24) and oil recirculation means arranged to orient the oil contained in the oil pan into the flow of refrigerant when the oil in the oil pan exceeds a predetermined oil level (34). The recirculation means include a recirculation line (35) housed in the sealed enclosure and comprising an inlet port (36) situated at a height substantially corresponding to the predetermined oil level, an outlet port (37) emerging in the refrigerant flow, and an intermediate part (38) connecting the inlet and outlet ports. The intermediate part (38) includes a first portion (38*a*) extending below the predetermined oil level (34).

13 Claims, 3 Drawing Sheets

(51) Int. Cl.

| | |
|---|---|
| ***F04C 18/02*** | (2006.01) |
| ***F04C 23/00*** | (2006.01) |
| ***F04C 29/02*** | (2006.01) |
| ***F04C 29/04*** | (2006.01) |
| ***F01C 1/02*** | (2006.01) |
| ***F01C 21/00*** | (2006.01) |

(52) U.S. Cl.
CPC ..... *F04C 2240/603* (2013.01); *F04C 2240/809* (2013.01); *F25B 31/004* (2013.01)

(56) References Cited

U.S. PATENT DOCUMENTS

| | | | | |
|---|---|---|---|---|
| 7,263,850 | B2 * | 9/2007 | Eom et al. | 62/286 |
| 2004/0126261 | A1 * | 7/2004 | Kammhoff et al. | 418/55.6 |
| 2009/0155111 | A1 * | 6/2009 | Okaichi et al. | 418/29 |
| 2011/0081254 | A1 * | 4/2011 | Hafkemeyer et al. | 417/13 |

* cited by examiner

REFRIGERATION COMPRESSOR THAT MAINTAINS A SATISFACTORY OIL LEVEL

TECHNICAL FIELD

The present invention relates to a refrigeration compressor, and a refrigeration system comprising at least one such refrigeration compressor.

BACKGROUND

A refrigeration system may comprise, in a known manner:

a circuit for circulating a refrigerant successively including a condenser, an expander, an evaporator, and a compression device connected in series, the compression device comprising at least one first compressor and one second compressor mounted in parallel, each compressor comprising an enclosure having a low-pressure part in particular containing an oil pan arranged in the bottom of the enclosure, a high-pressure part in particular containing a compression stage, a refrigerant inlet emerging in the low-pressure part, and a refrigerant outlet emerging in the high-pressure part, a refrigerant distribution device comprising a distribution pipe connected to the evaporator, a first bypass pipe putting the distribution pipe in communication with the refrigerant inlet of the first compressor, and a second bypass pipe putting the distribution pipe in communication with the refrigerant inlet of the second compressor, a refrigerant discharge device comprising a discharge pipe connected to the condenser, a first bypass pipe putting the discharge pipe in communication with the refrigerant outlet of the first compressor, and a second bypass pipe putting the discharge pipe in communication with the refrigerant outlet of the second compressor.

In order to ensure proper operation and good reliability of such a refrigeration system, it is necessary to balance the oil levels in the pans of the two compressors. This oil level balancing is advantageously obtained by arranging an oil separating device between the condenser and the compression device, by putting an oil outlet of the oil separating device in relation with the oil pans of the two compressors using an oil return pipe equipped with two bypass portions each connected to the oil pan of one of the compressors, and by providing a solenoid valve on each bypass portion arranged to open when the oil level in the corresponding compressor drops below a predetermined minimum value.

In this way, when the oil level in one of the compressors reaches a minimum value, the refrigeration system is arranged to favor a return of oil toward the compressor, so as to ensure a satisfactory oil level in each compressor.

Such a refrigeration system nevertheless has the drawback in particular of requiring the presence of solenoid valves, means for controlling the latter parts, and oil level sensors. This results in a complex, expensive refrigeration system, the reliability of which may be questionable, for example in the event of a failure of the solenoid valves, the means for controlling the latter parts, or the oil level sensors.

Document WO 2009/149726 discloses a refrigeration compressor comprising:

a sealed enclosure containing a compression stage and provided with a refrigerant inlet and a refrigerant outlet, the compressor being configured such that during usage conditions, a flow of refrigerant circulates through the refrigerant inlet, the compression stage, and the refrigerant outlet, an oil pan housed in the lower part of the sealed enclosure, and oil recirculation means arranged to orient the oil contained in the oil pan into the flow of refrigerant when the oil in the oil pan reaches or exceeds a predetermined oil level.

According to one embodiment described in document WO 2009/149726, the recirculation means include a bypass line comprising an inlet port emerging radially in the enclosure of the compressor and situated at a height substantially corresponding to the predetermined oil level, an outlet port emerging in the refrigerant inlet, and an intermediate part connecting the inlet and outlet ports of the recirculation line.

The compressor described in document WO 2009/149726 makes it possible, under certain operating conditions, to circulate the excess oil in the refrigerant flow.

Thus, when a refrigeration system is equipped with a plurality of compressors as described in document WO 2009/149726, each compressor is designed to prevent the oil level in the respective oil pan from exceeding a predetermined value, and therefore to ensure a minimum satisfactory oil level in the other compressors.

However, the structure and arrangement of the bypass line of such a compressor do not make it possible to begin suctioning the excess oil in the recirculation line, when the pressure difference between the inlet and outlet ports of the bypass line is small or when the difference in speed of the refrigerant on either side of the inlet and outlet ports of the bypass line is small.

Thus, under the operating conditions mentioned above, the oil level in one of the compressors may significantly exceed the predetermined oil level, and the oil level in one of the other compressors may thereby drop below a minimum satisfactory level, which may lead to poor lubrication of the moving parts of the compressor.

The present invention aims to resolve these drawbacks.

SUMMARY

The technical problem at the base of the invention therefore consists of providing a refrigerant compressor that has a simple, cost-effective, and reliable structure.

To that end, the present invention relates to a refrigeration compressor comprising:

a sealed enclosure containing a compression stage and provided with a refrigerant inlet and a refrigerant outlet, the compressor being configured such that under usage conditions, a flow of refrigerant circulates through the refrigerant inlet, the compression stage, and the refrigerant outlet, an oil pan housed in the lower portion of the sealed enclosure, oil recirculation means arranged to orient the oil contained in the oil pan into the flow of refrigerant when the oil in the oil pan reaches or exceeds a predetermined oil level, the recirculation means including a recirculation line housed in the sealed enclosure, the recirculation line comprising an inlet port emerging in the sealed enclosure and situated at a height substantially corresponding to the predetermined oil level, an outlet port emerging in the refrigerant flow, and an intermediate part connecting the inlet and outlet ports of the recirculation line, characterized in that the intermediate portion includes at least one first portion extending below the predetermined oil level, such that, when the oil in the oil pan exceeds the predetermined oil level, the excess oil penetrates the inlet port of the recirculation line and falls into the first portion by gravity.

When the oil in the oil pan is below the predetermined oil level, part of the refrigerant circulates inside the recirculation line. When the oil in the oil pan exceeds the predetermined oil level, the excess oil penetrates the inlet port of the recirculation line, falls into the first portion by gravity, and at least partially stops the passage section of the refrigerant. This results in an increased flow speed of the refrigerant inside the recirculation line, and therefore drives the excess oil to the outlet port. Next, the excess oil is driven into the refrigerant flow and leaves the compressor through the refrigerant outlet.

The arrangement of the first portion of the intermediate part of the recirculation line below the predetermined oil level thereby ensures easy and quick initiation of the suction of the excess oil, irrespective of the operating conditions of the compressor.

The configuration of the bypass line therefore makes it possible to ensure, irrespective of the operating conditions of the compressor, the discharge of the excess oil toward the refrigerant outlet by means of the refrigerant flow.

The compressor according to the invention consequently makes it possible to circulate the excess oil reliably, using a passive device, i.e. with no pump, electronic control means, valves, or similar members. This results in a simple, inexpensive, and reliable compressor.

According to one embodiment of the invention, the first portion of the intermediate part extends below the inlet port.

According to one embodiment of the invention, the first portion of the intermediate part is tubular.

The first portion of the intermediate part extending below the predetermined oil level is advantageously bent, and preferably is generally U-shaped. The recirculation line thus assumes the form of a siphon.

Preferably, the inlet port of the recirculation line is oriented substantially upward, i.e. the normal at the inlet section of the recirculation line is oriented upward. For example, the inlet port (more specifically the normal at the inlet section of the recirculation line) is oriented substantially perpendicular to the horizontal or forms an angle smaller than 45° with the vertical. These arrangements ensure better mastery of the oil level in the compressor, which still further improves the reliability thereof.

Preferably, the inlet port is arranged at the free end of the first portion.

Advantageously, the outlet port emerges in the refrigerant flow at a location situated downstream of the refrigerant inlet and upstream of the compression stage.

According to one embodiment of the invention, the outlet port is situated at a height higher than that of the inlet port.

Advantageously, the intermediate part includes a second substantially rectilinear portion connecting the first portion and the outlet port. According to one embodiment of the invention, the second portion of the intermediate part is tubular.

Preferably, the recirculation line is arranged such that under usage conditions, the pressure at the outlet port is lower than the pressure at the inlet port.

Preferably, the sealed enclosure includes a suction volume and a compression volume respectively arranged on either side of a body contained in the enclosure, the suction volume including the oil pan and the compression volume including the compression stage, the refrigerant inlet emerging in the suction volume.

According to one feature of the invention, the compressor includes an electric motor equipped with a stator and a rotor, and an intermediate casing surrounding the stator so as to delimit an annular outer volume with the sealed enclosure on the one hand and an inner volume on the other hand.

According to one embodiment of the invention, the rotor is secured to a driveshaft, in the form of a crankshaft, a first end of which is arranged to drive a moving part of the compression stage.

According to a first alternative embodiment of the invention, the outlet port of the recirculation line emerges in the inner volume delimited by the intermediate casing.

Advantageously, the outlet port of the recirculation line is arranged near the end of the electric motor turned toward the oil pan. Such an arrangement of the outlet port of the recirculation line limits the manometric height to be overcome to initiate suction of the excess oil, which ensures initiation of suction of the excess oil when the pressure difference between the inlet and outlet ports of the recirculation line is very small. This also improves the reliability of the compressor.

According to one embodiment of the invention, the compressor includes a centering part fastened on the sealed enclosure and provided with a guide bearing for an end portion of the driveshaft turned toward the oil pan, the recirculation line being mounted on the centering part.

Advantageously, the end of the intermediate casing turned toward the oil pan is mounted on the centering part, the centering part and/or the intermediate casing delimiting at least one opening intended for the passage of the refrigerant from the annular outer volume toward the inner volume.

According to a second alternative embodiment of the invention, the outlet port of the recirculation line emerges in the compression volume, upstream of the compression stage.

According to one embodiment of the invention, the second portion of the intermediate part of the recirculation line extends in the annular outer volume delimited by the intermediate casing.

According to another embodiment of the invention, the recirculation line is mounted on a fastening part arranged to fasten the centering part of the enclosure.

According to one feature of the invention, the end of the intermediate casing opposite the oil pan is fastened on the body separating the suction and compression volumes, such that the intermediate casing serves to fasten the electric motor.

According to one embodiment of the invention, the end portion of the recirculation line situated on the side of the outlet port is inserted in a through bore formed in the body separating the compression and suction volumes.

Advantageously, the compression stage comprises a stationary scroll and a movable scroll each comprising a scroll, the scroll of the moving scroll being engaged in the scroll of the stationary scroll and being driven following an orbital movement, the moving scroll bearing against the body separating the compression and suction volumes.

The drive member equipping the first end of the driveshaft is preferably arranged to drive the moving volume in an orbital movement.

According to one feature of the invention, the driveshaft includes a second end driving an oil pump arranged to supply, from oil contained in the oil pan, a pipe formed in the central part of the driveshaft.

The present invention also relates to a refrigeration system, comprising a refrigerant circulation circuit successively having a condenser, an expander, an evaporator, and a compression device connected in series, characterized in that the compression device comprises at least one compressor according to the invention.

According to a first embodiment of the refrigeration system, the compression device comprises only one compressor according to the invention. The compressor may for example be a variable-capacity compressor, for example a variable-speed compressor. The compressor may also be a fixed-speed compressor.

According to a second embodiment of the refrigeration system, the compression device comprises a plurality of compressors mounted in parallel, at least one of the compressors being a compressor according to the invention. Advantageously, at least one of the compressors is a variable-capacity compressor, for example a variable-speed compressor, or a fixed-speed compressor. Advantageously, at least one of the compressors is a variable-speed compressor and at least one of the other compressors is a fixed-speed compressor. Preferably, each compressor is a compressor according to the invention.

In this patent application, the terms "first portion" and "second portion" of the intermediate part respectively designate a "first segment" and "second segment" of the intermediate part.

In any case, the invention will be well understood using the following description in reference to the appended diagrammatic drawing showing, as non-limiting examples, two embodiments of this refrigeration compressor.

DETAILED DESCRIPTION

Figure 1:
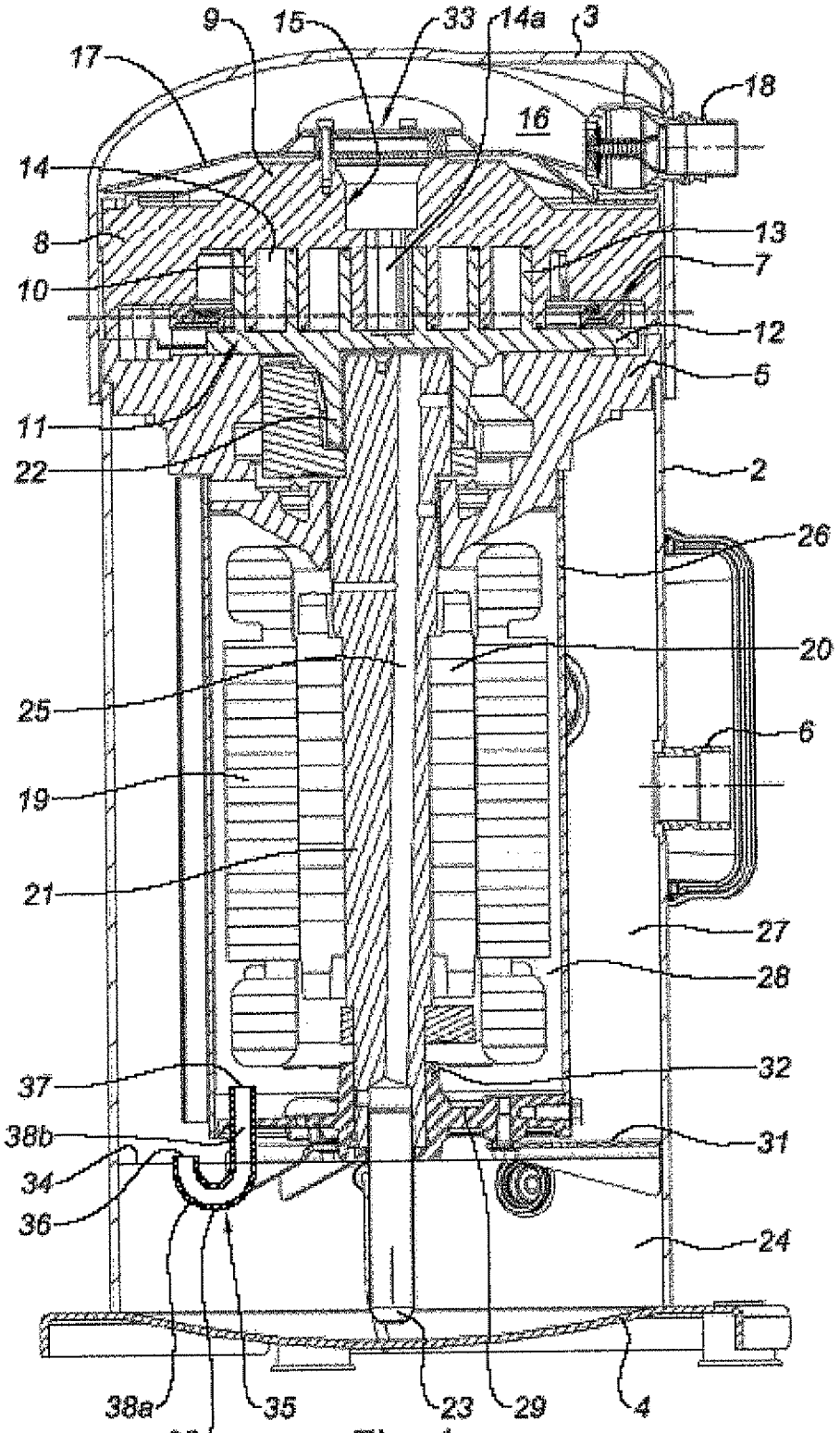
FIG. 1 is a longitudinal cross-sectional view of a compressor according to a first embodiment of the invention.

FIG. 1 describes a scroll refrigeration compressor in a vertical position. However, the compressor according to the invention may assume an inclined position, or a horizontal position, without its structure being significantly altered.

The compressor shown in FIG. 1 comprises a sealed enclosure delimited by a shroud 2 whereof the upper and lower ends are respectively closed by a lid 3 and a base 4. This enclosure may in particular be assembled using weld beads.

The intermediate part of the compressor is occupied by a body 5 that delimits two volumes, a suction volume situated below the body 5, and a compression volume arranged above the latter part. The shroud 2 comprises a refrigerant inlet 6 emerging in the suction volume to convey the refrigerant to the compressor.

The body 5 serves to mount a compression stage 7 for the refrigerant. This compression stage 7 comprises a stationary scroll 8 having a plate 9 from which a stationary spiral 10 extends turned downward, and a moving scroll 11 having a plate 12 bearing against the body 5 and from which a spiral 13 extends turned upward. The two spirals 10 and 13 of the two scrolls penetrate one another to form variable-volume compression chambers 14.

The compressor also comprises a discharge pipe 15 formed in the central part of the stationary scroll 8. The discharge pipe 15 comprises a first end emerging in the central compression chamber 14*a* and a second end designed to be put in communication with a high-pressure discharge chamber 16 formed in the enclosure of the compressor. The discharge chamber 16 is delimited partially by a separating plate 17 mounted on the plate 9 of the stationary scroll 8 so as to surround the discharge pipe 15.

The compressor also comprises a refrigerant outlet 18 emerging in the discharge chamber 16.

The compressor comprises a three-phase electric motor arranged in the suction volume. The electric motor comprises a stator 19, at the center of which a rotor 20 is arranged.

The rotor 20 is secured to a driveshaft 21, the upper end of which is out of alignment, like a crankshaft. This upper part is engaged on a sleeve or bush 22 of the moving scroll 11. When it is rotated by the motor, the driveshaft 21 drives the moving scroll 11 in an orbital movement.

The lower end of the driveshaft 21 drives an oil pump 23 supplying, from oil contained in an oil pan 24 delimited by the base 4, an oil supply pipe 25 formed in the central part of the driveshaft 21, the supply pipe 25 being out of alignment and preferably extending over the entire length of the driveshaft 21.

The compressor also comprises an intermediate casing 26 surrounding the stator 19. The end of the intermediate casing 26 opposite the oil pan 24 is fastened on the body 5 separating the suction and compression volumes, such that the intermediate casing 26 serves to fasten the electric motor. The intermediate casing 26 delimits an annular outer volume 27 with the sealed enclosure on the one hand, and an inner volume 28 containing the electric motor on the other hand.

The compressor also comprises a centering part 29, fastened on the sealed enclosure using the fastening part 31, provided with a guide bearing 32 arranged to guide the end portion of the driveshaft 21 turned toward the oil pan 24. The end of the intermediate casing 26 turned toward the oil pan rests on the centering part 29. The centering part 29 and/or the intermediate casing 26 advantageously have at least one opening intended for the passage of the refrigerant from the annular outer volume 27 toward the inner volume 28.

The compressor also comprises an anti-return device 33 mounted on the plate 9 of the stationary scroll 8 and the second end of the discharge pipe 15, and in particular having a discharge valve movable between a covering position preventing the discharge pipe 15 from being put in communication with the discharge chamber 16, and a release position allowing the discharge pipe 15 to be put in communication with the discharge chamber 16. The discharge valve is designed to be moved into its release position when the pressure in the discharge pipe 15 exceeds the pressure in the discharge chamber 16 by a first predetermined value substantially corresponding to the adjustment pressure of the discharge valve.

The compressor is configured such that under usage conditions, a refrigerant flow circulates through the refrigerant inlet 6, the annular outer volume 27, the inner volume 28, the compression stage 7, the discharge pipe 15, the anti-return device 33, the discharge chamber 16, and the refrigerant outlet 18.

The compressor comprises oil recirculation means arranged to orient the oil contained in the oil pan 24 into the refrigerant flow when the oil in the oil pan reaches or exceeds a predetermined oil level 34.

The recirculation means include a recirculation line 35 housed in the enclosure. The recirculation line 35 is for example mounted on the centering part 29.

The recirculation line 35 includes an inlet port 36 oriented upward and situated at a height substantially corresponding to the predetermined oil level 34, an outlet port 37 emerging in the refrigerant flow at a location situated downstream of the refrigerant inlet 6 and upstream of the compression stage 7, and an intermediate part 38 connecting the inlet and outlet ports of the recirculation line 35. The intermediate part 38 includes at least one generally U-shaped bent first portion 38*a* extending below the predetermined oil level 34, and a second substantially rectilinear portion 38*b* extending substantially vertically. The first and second portions 38*a*, 38*b* of the intermediate part 38 are tubular. The first portion 38*a* has a first end at which the inlet port 36 is arranged and a second end connected to a first end of the second portion 38*b*, the outlet port 37 being formed at the second end of the second portion 38*b*. Advantageously, the first portion 38*a* of the intermediate part 38 extends below the inlet port 36.

The outlet port 37 is situated at a height higher than that of the inlet port 36, and is arranged near the end of the electric motor turned toward the oil pan 24. In this way, the outlet port of the recirculation line emerges in the inner volume 28 delimited by the intermediate casing 26. Due to the reduced passage section of the refrigerant between the annular outer volume and the inner volume, under usage conditions, the pressure at the outlet port 37 is lower than the pressure at the inlet port 36.

When the oil in the oil pan 24 exceeds the predetermined oil level 34, the excess oil penetrates the inlet port 36 of the recirculation line 35, falls in the first bent portion 38*a* by gravity, and is suctioned as far as the outlet port 37 due to the pressure difference between the inlet and outlet ports. Then, the excess oil is driven into the refrigerant flow and leaves the compressor through the refrigerant outlet 18.

In this way, when the compressor according to the invention is for example incorporated into a refrigeration system comprising a plurality of compressors mounted in parallel, the excess oil leaving the compressor according to the invention is circulated in the refrigeration system and is then distributed into the different compressors, which ensures a return of oil toward the other compressors, and therefore a minimum quantity of oil in the oil pans thereof.

Figure 2:
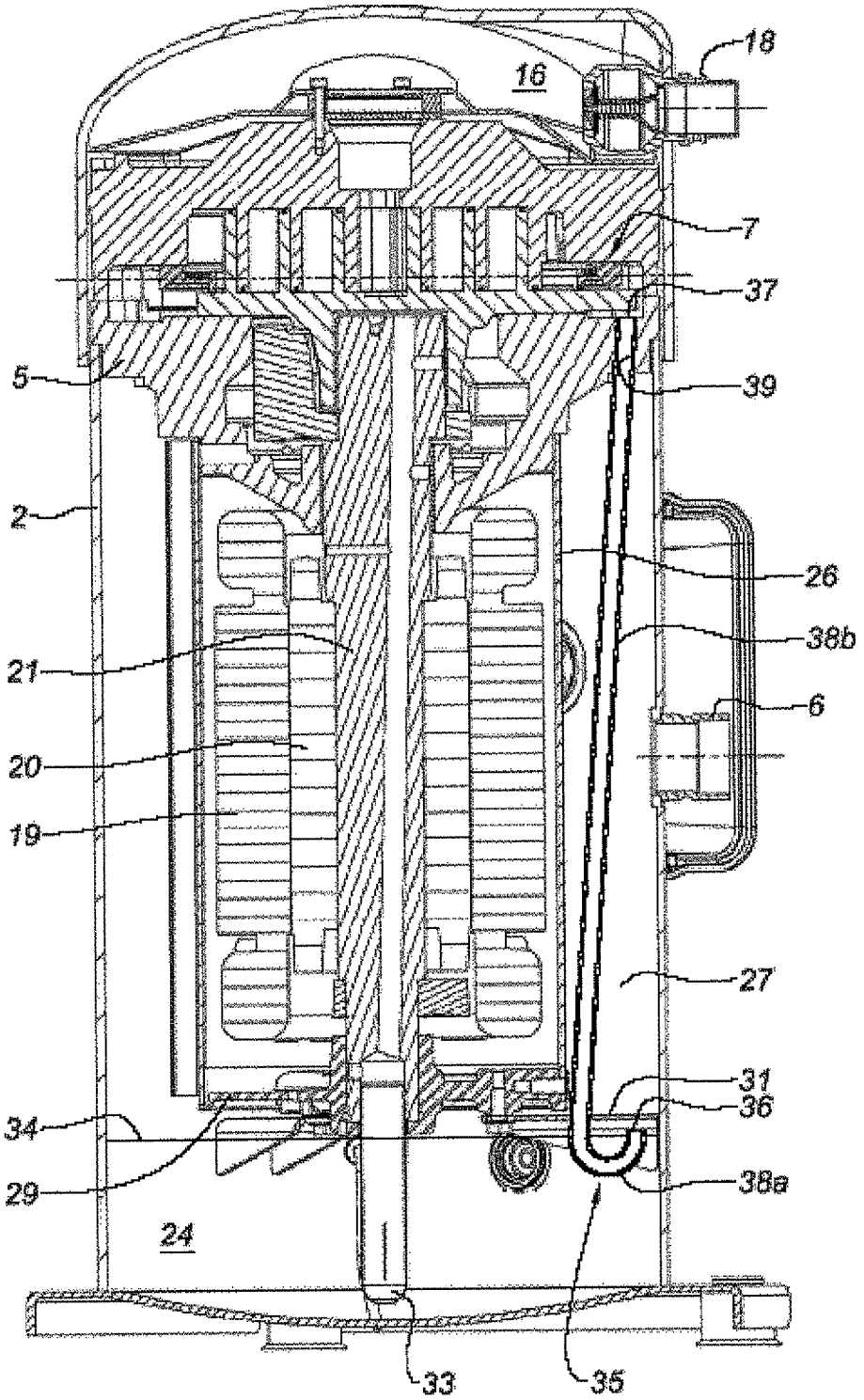
FIG. 2 is a longitudinal cross-sectional view of a compressor according to a second embodiment of the invention.

FIG. 2 shows a second embodiment differs from that shown in FIG. 1 essentially in that the outlet port 37 of the recirculation line 35 emerges in the compression volume, upstream of the compression stage 7, and in that the end portion of the recirculation line 35 situated on the side of the outlet port 37 is inserted into a through bore 39 formed in the body 5 separating the compression and suction volumes.

According to this embodiment, the second portion 38*b* of the intermediate part 38 of the recirculation line 35 extends in the annular outer volume 27 partially delimited by the intermediate casing 26, and the recirculation line 35 is mounted on the fastening part 31 arranged to fasten the centering part 29 on the enclosure.

Figure 3:
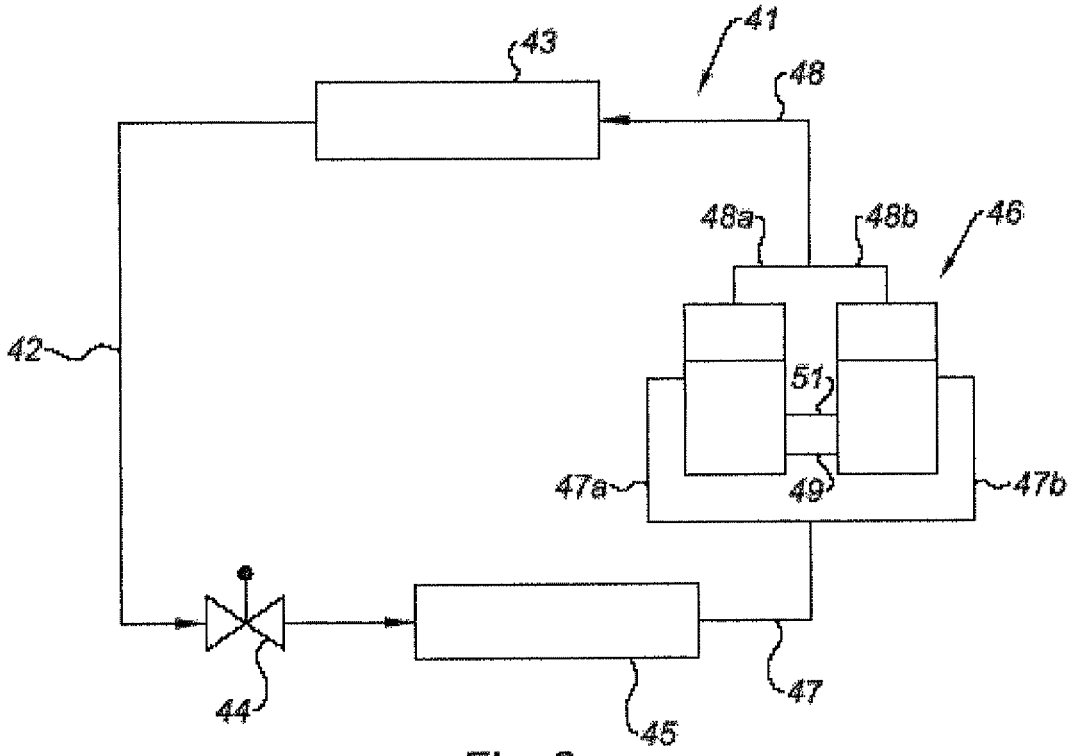
FIG. 3 is a diagrammatic view of a refrigeration system according to the invention.

FIG. 3 shows a refrigeration system 41 comprising a refrigerant circulation circuit 42 successively having a condenser 43, an expander 44, an evaporator 45, and a compression device 46 connected in series. The compression device 46 comprises two compressors according to the invention mounted in parallel.

Advantageously, one of the compressors is a variable-capacity compressor, and in particular a variable-speed capacity, and preferably the other compressor is a fixed-speed compressor.

The refrigeration system 41 also comprises a refrigerant distribution device comprising a distribution pipe 47 connected to the evaporator 45, a first bypass pipe 47*a* putting the distribution pipe 47 in communication with the refrigerant inlet of the first compressor, and a second bypass pipe 47*b* putting the distribution pipe 47 in communication with the refrigerant inlet of the second compressor.

The refrigeration system 41 also comprises a refrigerant discharge device comprising a discharge pipe 48 connected to the condenser 43, a first bypass pipe 48*a* putting the discharge pipe 48 in communication with the refrigerant outlet of the first compressor, and a second bypass pipe 48*b* putting the discharge pipe 48 in communication with the refrigerant outlet of the second compressor.

The refrigeration system 41 also comprises an oil level equalization pipe 49 putting the oil pans 24 of the two compressors in communication, and a pressure equalization pipe 51 putting the suction volumes of the two compressors in communication.

According to one embodiment not shown in the figures, the refrigeration system 41 could be provided with no oil level equalization pipe and/or pressure equalization pipe.

According to another embodiment not shown in the figures, the refrigeration system 41 could comprise an equalization pipe with a large diameter forming an oil level and pressure equalization pipe.

According to still another embodiment not shown in the figures, the refrigeration system 41 could have an oil separating device arranged between the condenser 43 and the compression device 46, and an oil return pipe connecting an oil outlet of the oil separating device with the oil pans 24 of the two compressors, the return pipe being provided with no solenoid valves or electronic device.

According to still another embodiment not shown in the figures, the compression device 46 of the refrigeration system 41 could have only a single compressor, i.e. a compressor according to the invention.

The invention is of course not limited solely to the embodiments of this refrigeration compressor described above as examples, but on the contrary encompasses all alternative embodiments.

The invention claimed is:

1. A refrigeration compressor comprising:

a sealed enclosure containing a compression stage and provided with a refrigerant inlet and a refrigerant outlet, the compressor being configured such that under usage conditions, a flow of refrigerant circulates through the refrigerant inlet, the compression stage, and the refrigerant outlet, an oil pan housed in the lower portion of the sealed enclosure, oil recirculation means arranged to orient the oil contained in the oil pan into the flow of refrigerant when the oil in the oil pan reaches or exceeds a predetermined oil level, the recirculation means including a recirculation line housed in the sealed enclosure, the recirculation line comprising an inlet port emerging in the sealed enclosure and situated at a height substantially corresponding to the predetermined oil level, an outlet port emerging in the refrigerant flow, and an intermediate part connecting the inlet and outlet port of the recirculation line, wherein the intermediate part includes at least one first portion extending below the predetermined oil level, such that, when the oil in the oil pan exceeds the predetermined oil level, the excess oil penetrates the inlet port of the recirculation line and falls into the first portion by gravity, the compressor includes an electric motor equipped with a stator and a rotor, and an intermediate casing surrounding the stator so as to delimit an annular outer volume with the sealed enclosure on the one hand and an inner volume on the other hand, and the outlet port of the recirculation line emerges in the inner volume delimited by the intermediate casing.

2. The compressor according to claim 1, wherein the first portion of the intermediate part extending below the predetermined oil level is generally U-shaped.

3. The compressor according to claim 1, wherein the inlet port of the recirculation line is oriented substantially upward.

4. The compressor according to claim 1, wherein the intermediate part includes a second substantially rectilinear portion connecting the first portion and the outlet port.

5. The compressor according to claim 1, wherein the recirculation line is arranged such that under usage conditions, the pressure at the outlet port is lower than the pressure at the inlet port.

6. The compressor according to claim 1, wherein the sealed enclosure includes a suction volume and a compression volume respectively arranged on either side of a body contained in the sealed enclosure, the suction volume including the oil pan, and the compression volume including the compression stage, the refrigerant inlet emerging in the suction volume.

7. The compressor according to claim 1, wherein the rotor is secured to a driveshaft, in the form of a crankshaft, a first end of the driveshaft being arranged to drive a moving part of the compression stage.

8. The compressor according to claim 1, wherein the outlet port of the recirculation line is arranged near the end of the electric motor turned toward the oil pan.

9. The compressor according to claim 7, wherein the compressor includes a centering part fastened on the sealed enclosure and provided with a guide bearing for an end portion of the driveshaft turned toward the oil pan, the recirculation line being mounted on the centering part.

10. The compressor according to claim 9, wherein an end of the intermediate casing turned toward the oil pan is mounted on the centering part, the centering part and/or the intermediate casing delimiting at least one opening intended for passage of the refrigerant from the annular outer volume toward the inner volume.

11. The compressor according to claim 6, wherein the outlet port of the recirculation line emerges in the compression volume, upstream of the compression stage.

12. The compressor according to claim 11, wherein an end portion of the recirculation line situated on the side of the outlet port is inserted in a through bore formed in the body separating the compression and suction volumes.

13. A refrigeration system, comprising a refrigerant circulation circuit successively having a condenser, an expander, an evaporator, and a compression device connected in series, wherein the compression device comprises at least one compressor according to claim 1.

* * * * *